US010442239B2

(12) United States Patent
Chang

(10) Patent No.: US 10,442,239 B2
(45) Date of Patent: Oct. 15, 2019

(54) LIFTING STRUCTURE OF ENGRAVING MACHINE

(71) Applicant: KINGSAND MACHINERY LTD., Taichung (TW)

(72) Inventor: Chin-Feng Chang, Taichung (TW)

(73) Assignee: KINGSAND MACHINERY LTD., Taichung (TW)

( * ) Notice: Subject to any disclaimer, the term of this patent is extended or adjusted under 35 U.S.C. 154(b) by 231 days.

(21) Appl. No.: 15/675,778

(22) Filed: Aug. 13, 2017

(65) Prior Publication Data

US 2019/0047322 A1 Feb. 14, 2019

(51) Int. Cl.
*B44B 3/06* (2006.01)
*B44B 1/06* (2006.01)

(52) U.S. Cl.
CPC ..... *B44B 3/065* (2013.01); *B44B 1/06* (2013.01)

(58) Field of Classification Search
CPC ..... B44B 3/065; B44B 1/06
See application file for complete search history.

*Primary Examiner* — David B. Thomas
(74) *Attorney, Agent, or Firm* — Raymond Y. Chan; David and Raymond Patent Firm

(57) ABSTRACT

A lifting structure of an engraving machine is provided. A lifting platform of the engraving machine has four pivot holes each provided with a screw seat, and is mounted with a shaft seat having a drive gear. A sprocket is provided under each screw seat. A driven gear is provided under one of the sprockets to mesh with the drive gear. The sprockets of the pivot holes are connected by a chain. The screw seat includes an upper screw sleeve, a lower screw sleeve, an upper thrust bearing, a lower thrust bearing, and a spring. The lower screw sleeve is rotatable in the pivot hole through the upper thrust bearing and the lower thrust bearing. The spring is located between the upper screw sleeve and the lower screw sleeve. Two screws pass through the upper screw seat and are screwed to the lower screw seat, respectively.

6 Claims, 9 Drawing Sheets

LIFTING STRUCTURE OF ENGRAVING MACHINE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a lifting structure of an engraving machine, and more particularly to a lifting structure able to compensate the gap between a screw seat of a lifting platform and a screw rod.

Description of Related Arts

As shown in FIG. 1 to FIG. 5, a conventional engraving machine includes a platform 11 suspended in a mounting trough 2 of a worktable 1. The platform 11 has a blade hole 111 and a receiving hole 113 for insertion of a wrench 112. A plurality of screw rods 12 are vertically provided under the bottom surface of the platform 11. The screw rods 12 are arranged in parallel with each other. The blade hole 111 is located among the screw rods 12. A lifting platform 13 is located under the platform 11. The lifting platform 13 is provided with pivot holes 131 corresponding in position to the screw rods 12. Each pivot hole 131 is provided with a screw seat 14 for engagement of the screw rod 12. The lifting platform 13 has a connecting hole 132 corresponding in position to the receiving hole 113 and a through hole 133 corresponding in position to the blade hole 111. The connecting hole 132 is mounted with a rotatable shaft seat 15. Each of the screw seats 14 and the shaft seat 15 is provided with a sprocket 16. The sprockets 16 are connected by a chain 17. The screw seat 14 is provided with a screw sleeve 141 which is rotatable in the pivot hole 131 through an upper thrust bearing 142 and a lower thrust bearing 143. A top end of the screw sleeve 141 is provided with a head portion 144 having a diameter greater than that of the upper thrust bearing 142. A keyway 145 is provided at the bottom of the screw sleeve 141. A screw hole 146 for engagement of the screw rod 12 is formed in the center of the screw sleeve 141. A sprocket 16 is coaxially connected to the bottom of the screw sleeve 141. The sprocket 16 is provided with a mounting hole 161 for mounting the screw sleeve 141 and a notch 162 corresponding to the keyway 145. A key 147 is provided in the keyway 145 and the notch 162. The key 147 is positioned by a fixing screw 163 of the sprocket 16 so that the sprocket 16 and the screw sleeve 141 are coaxially rotated. The lifting platform 13 is provided with an adjustment groove 134 and an idler gear 18 below the adjustment groove 134. An adjustment screw 181 is inserted through the adjustment groove 134 and screwed to the idler gear 18. The idler gear 18 is movable in the adjustment groove 134 and meshed with the outer side of the chain 17 so that the idler gear 18 can adjust the tightness of the chain 17. A motor 19 is mounted to the bottom surface of the lifting platform 13. A cutter 192 is assembled to a rotary shaft 191 of the motor 19. When the wrench 112 drives the sprocket 16 of the shaft seat 15 to rotate, the chain 17 drives the sprockets 16 of the screw seats 14 to rotate so that the lifting platform 13 can be raised and lowered along the screw rods 12 to adjust the height of the cutter 192 of the motor 19 to extend out of the blade hole 111 for engraving the wood. In the above-described structure, there will be a gap between the screw sleeve 141 of the screw seat 14 and the screw rod 12 when they are meshed with each other, and the thread positions of the screw rods 12 at the four corners of the lifting platform 1 are different, resulting in a shake due to the difference between the gaps. When the lifting platform 113 is moved up and down by turning the wrench 112, the wrench 112 drives the sprocket 16 of the shaft seat 15. When the chain 17 drives the screw seats 14 to rotate, the degree of lifting is not coordinated, the height is different, and the operation is not smooth. Accordingly, the inventor of the present invention has devoted himself based on his many years of practical experiences to solve these problems.

SUMMARY OF THE PRESENT INVENTION

The primary object of the present invention is to solve the aforesaid problems and to provide a lifting structure of an engraving machine. A screw seat at each of four corners of a lifting platform is provided with an upper screw sleeve and a lower screw sleeve. A spring is provided between the upper screw sleeve and the lower screw sleeve. The spring is supported between the upper screw sleeve and the lower screw sleeve, so that the upper screw sleeve can be biased upward to compensate the gap between the upper screw sleeve and a screw rod, and the lower screw sleeve can be biased downward to compensate the gap between the lower screw sleeve and the screw rod. The screw seat is stably engaged with the screw rod so that the lifting platform can be lifted smoothly and stably.

DETAILED DESCRIPTION OF THE PREFERRED EMBODIMENT

Embodiments of the present invention will now be described, by way of example only, with reference to the accompanying drawings.

Figure 1:
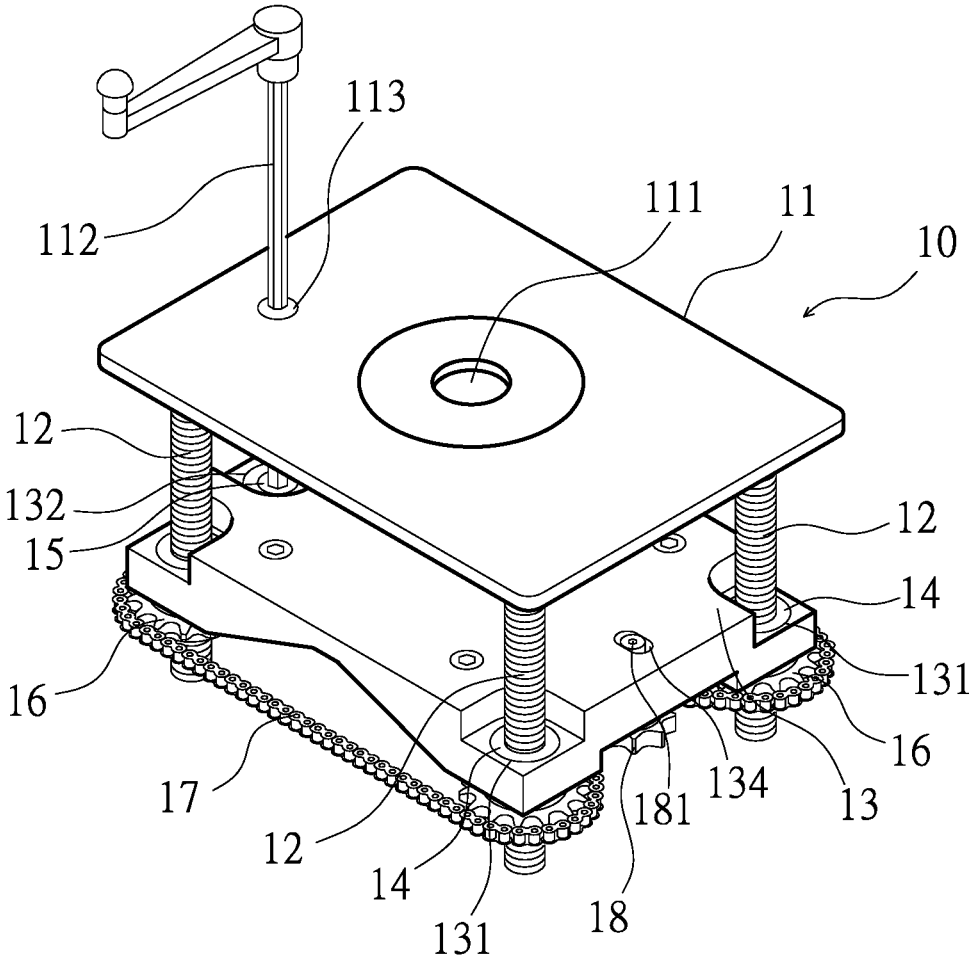
PRIOR ART FIG.1
FIG. 1 is a perspective view of a conventional engraving machine.
Figure 2:
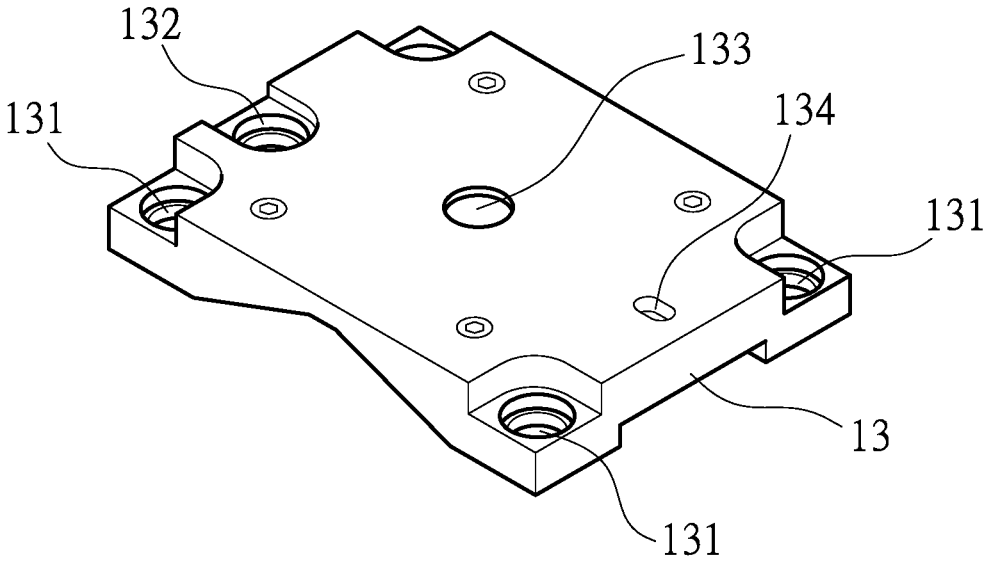
PRIOR ART FIG.2
FIG. 2 is a front perspective view of a conventional lifting platform.
Figure 3:
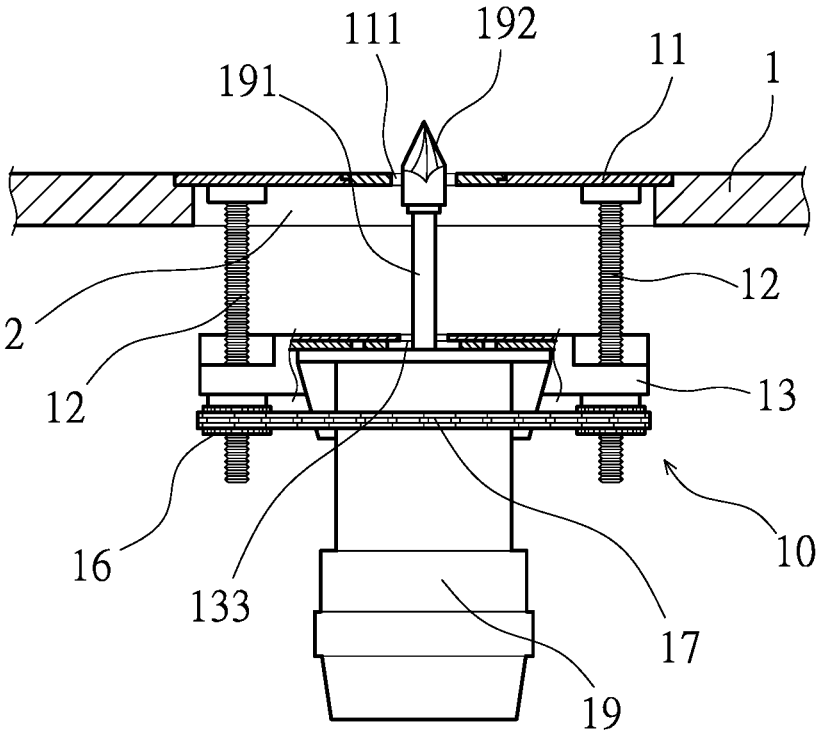
PRIOR ART FIG.3
FIG. 3 is a sectional view of the conventional lifting platform mounted to an operating platform.
Figure 4:
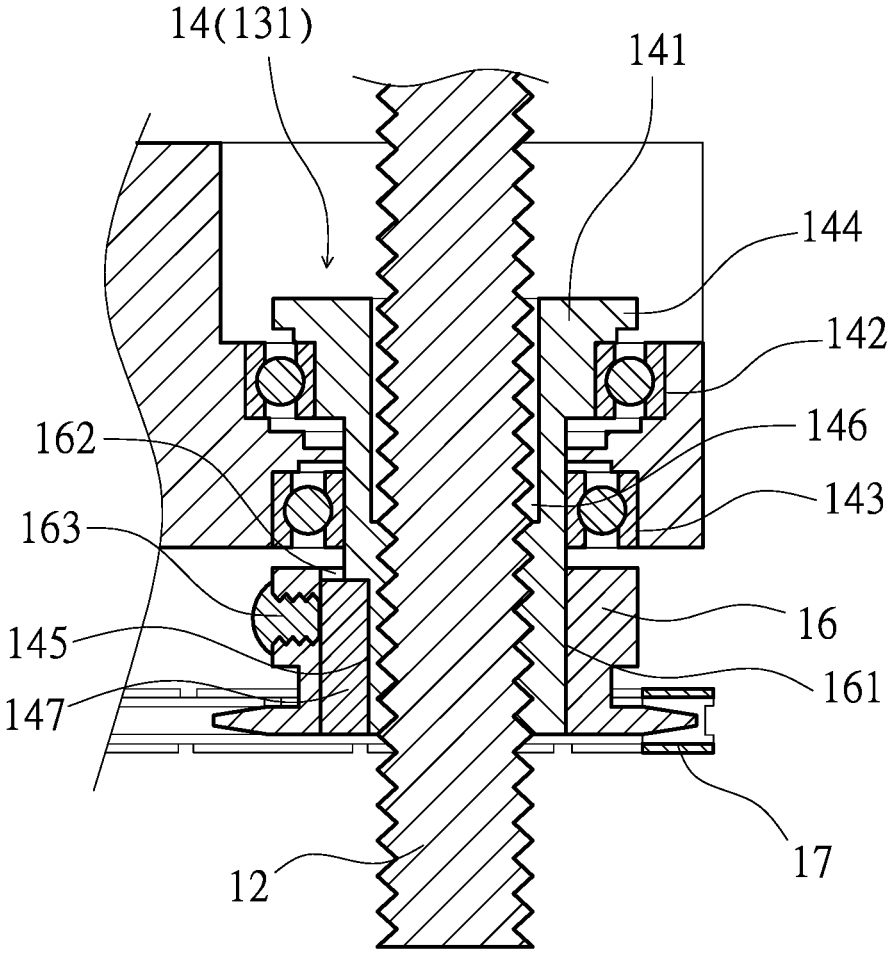
PRIOR ART FIG.4
FIG. 4 is a sectional view of a conventional screw seat.
Figure 5:
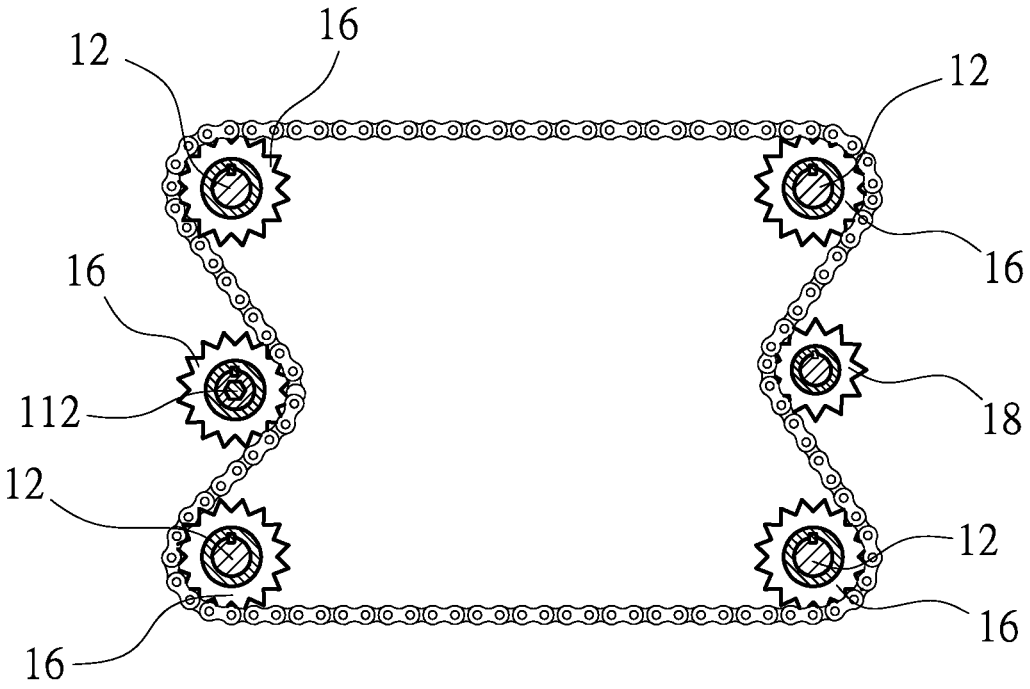
PRIOR ART FIG.5
FIG. 5 is a schematic view of the interconnection of conventional sprockets.
Figure 6:
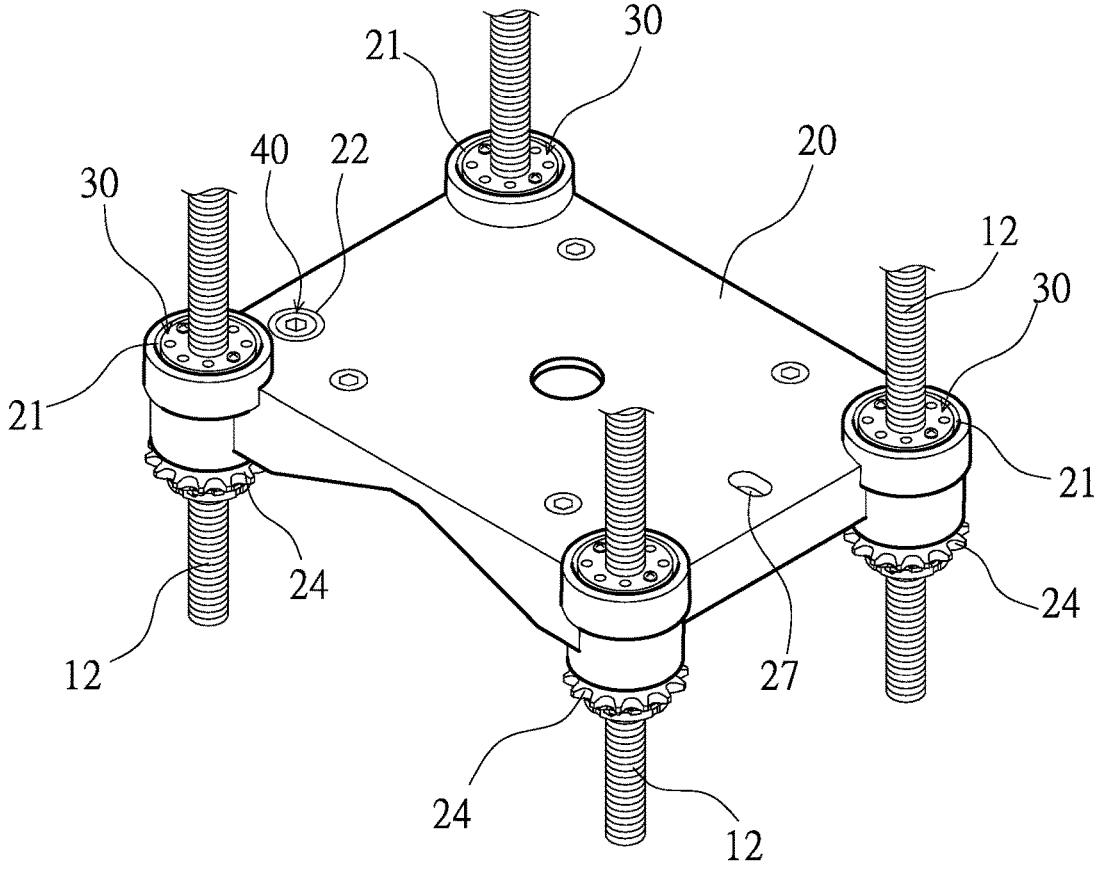
FIG. 6 is a perspective view of the screw seats of the lifting platform meshed with the screw rods of the present invention.
Figure 7:
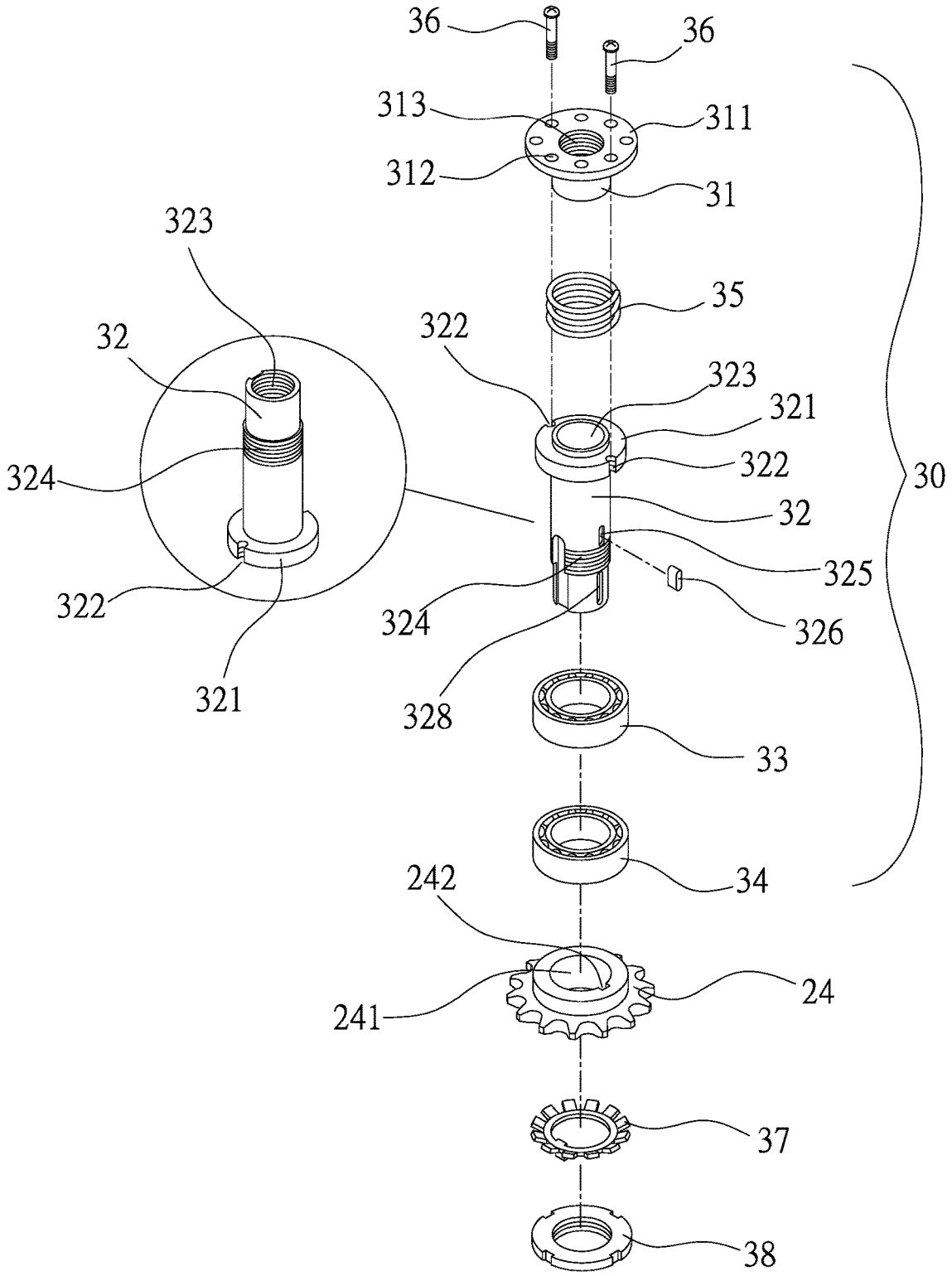
FIG. 7 is an exploded view of the present invention.
Figure 8:
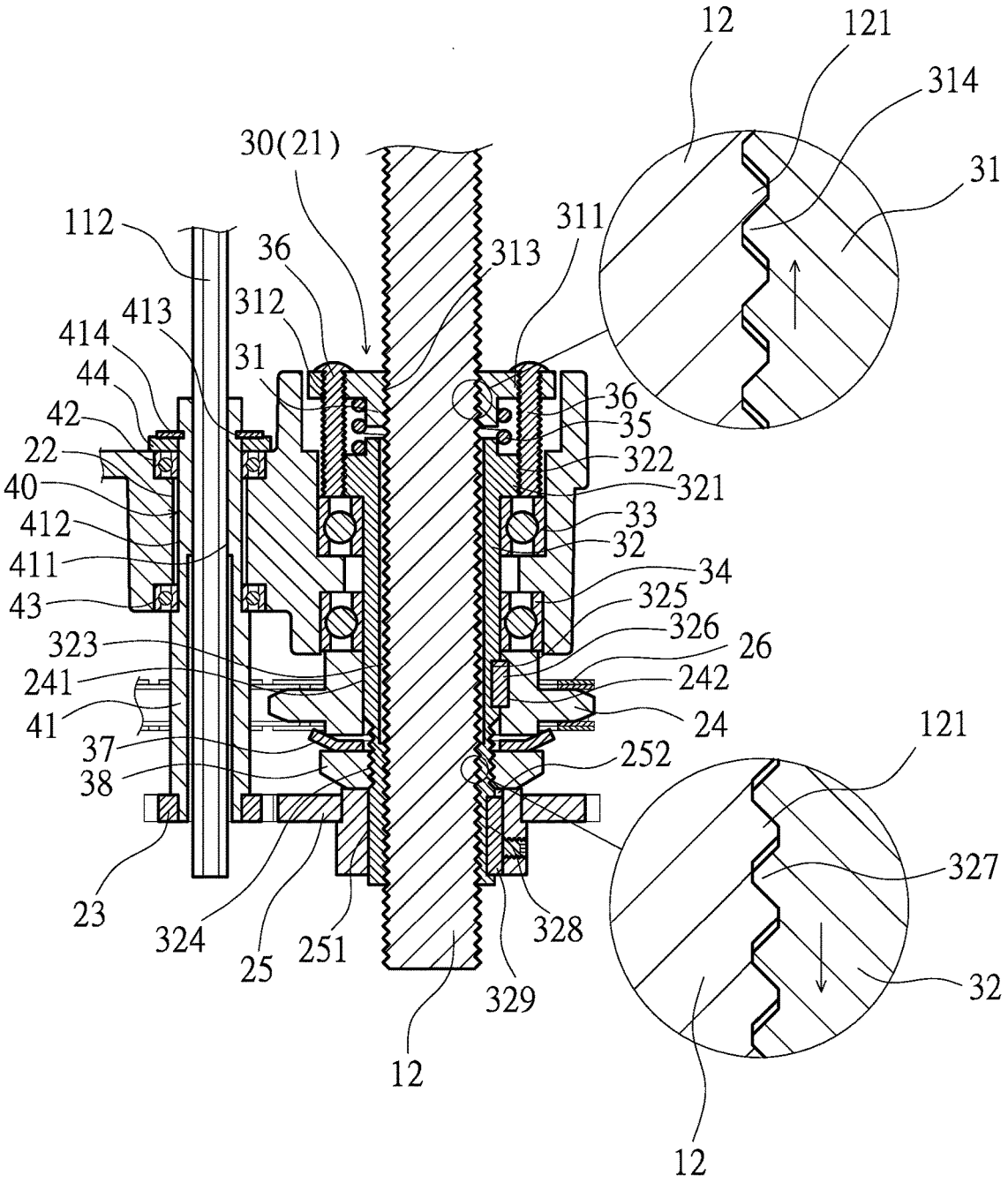
FIG. 8 is a sectional view of the screw seat of the present invention.
Figure 9:
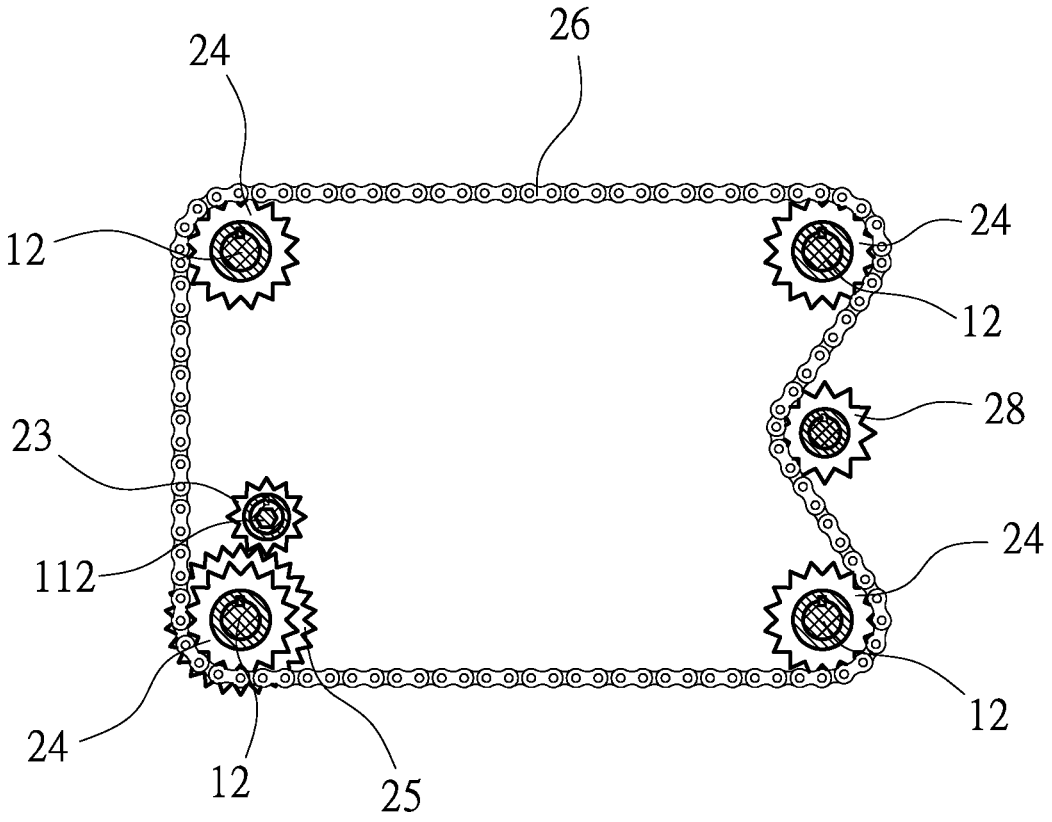
FIG. 9 is a schematic view of the interconnection of the sprockets of the present invention.

Referring to FIG. 6 to FIG. 9, a lifting platform 20 of an engraving machine has pivot holes 21 each corresponding in position to a screw rod 12. Each of the pivot holes 21 is provided with a screw seat 30 for engagement of the screw rod 12. The lifting platform 20 further has a connecting hole 22. The connecting hole 22 is mounted with a rotatable shaft seat 40. A drive gear 23 is provided below the shaft seat 40. A sprocket 24 is provided below the screw seat 30. A driven gear 25 is provided below the sprocket 24 to mesh with the drive gear 23. The sprockets 24 of the pivot holes 21 are connected by a chain 26. The screw seat 30 includes an upper screw sleeve 31, a lower screw sleeve 32, an upper thrust bearing 33, a lower thrust bearing 34, and a spring 35. A top end of the upper screw sleeve 31 is provided with a disc portion 311. The disk portion 311 has a plurality of perforations 312 arranged in a circle and a central upper screw hole 313 for engagement of the screw rod 12. The lower screw sleeve 32 is rotatable in the pivot hole 21 through the upper thrust bearing 33 and the lower thrust bearing 34. A top end of the lower screw sleeve 32 has a head portion 321 having a diameter greater than that of the upper thrust bearing 33. The head portion 321 has two positioning screw holes 322 corresponding in position to the perforations 312 and a central lower screw hole 323 for engagement of the screw rod 12. The spring 35 is located between the upper screw sleeve 31 and the lower screw sleeve 32, so that an upper end of the spring 35 abuts against the disc portion 311 and a lower end of the spring 35 abuts against the head portion 321. Two screws 36 pass through the perforations 312 and are screwed to the positioning screw holes 322, respectively. An outer wall of the lower screw sleeve 32 is provided with an outer threaded portion 324. The lower screw sleeve 32 is provided with a first keyway 325 above the outer threaded portion 324. The bottom of the lower screw sleeve 32 is coaxially connected with the sprocket 24. The sprocket 24 has a mounting hole 241 for receiving the lower screw sleeve 32 and a first notch 242 corresponding to the first keyway 325. A first key 326 is disposed in the first keyway 325 and the first notch 242, so that the sprocket 24 and the lower screw sleeve 32 are coaxially rotated. A disc spring 37 is provided below the sprocket 24. The threaded portion 324 is screwedly connected with a thread ring 38. The thread ring 38 is configured to urge the disc spring 37 and the sprocket 24. The lifting platform 20 is provided with an adjustment groove 27 and an idler gear 28 under the adjustment groove 27. The idler gear 28 is displaceable in the adjustment groove 27. The idler gear 28 is connected with an outer side of the chain 26, such that the idler gear 28 can adjust the tightness of the chain 26. The shaft seat 40 includes a sleeve 41, a first bearing 42, a second bearing 43, and a positioning plate 44. The sleeve 41 has a central drive hole 411. An upper end of the sleeve 41 is provided with a receiving portion 412. The receiving portion 412 is formed with an annular groove 413. A C-shaped buckle 414 is engaged in the annular groove 413. The sleeve 41 is rotatable in the connecting hole 22 through the first bearing 42 and the second bearing 43. The positioning plate 44 is located between the C-shaped buckle 414 and the first bearing 42. The bottom of the sleeve 41 is coaxially connected with the drive gear 23. According to the above-described structure, the spring 35 is supported between the upper screw sleeve 31 and the lower screw sleeve 32, so that the upper screw sleeve 31 can be biased upward to compensate the gap between the upper screw sleeve 31 and the screw rod 12, and the lower screw sleeve 32 can be biased downward to compensate the gap between the lower screw sleeve 32 and the screw rod 12. The screw seat 30 is stably engaged with the screw rod 12 so that the lifting platform 20 can be lifted smoothly and stably.

The assembly, function and details of the above-described embodiment are described hereinafter. Referring to FIG. 6 to FIG. 9, the upper screw sleeve 31 of the screw seat 30 is first screwed to the screw rod 12, and the spring 35 is fitted under the upper screw sleeve 31, and then the lower screw sleeve 32 is screwed to the screw rod 12. The upper end of the spring 35 abuts against the disc portion 311 of the upper screw sleeve 31, and the lower end of the spring 35 abuts against the head portion 321 of the lower screw sleeve 32. The screws 36 pass through the perforations 312 and are screwed to the positioning screw holes 322 symmetrically to fix the angle between the upper screw sleeve 31 and the lower screw sleeve 32, so that the upper screw sleeve 31 and the lower screw sleeve 32 cannot be rotated each other. The upper screw sleeve 31 is movable in the axial direction of the screws 36. The upper screw sleeve 31 and the lower screw sleeve 32 are spaced from each other, not in contact with each other. Through the elastic force of the spring 35, the upper edge of the screw thread 314 of the upper screw hole 313 abuts against the lower edge of the screw thread 121 of the screw rod 12. The lower edge of the screw thread 327 of the lower screw hole 323 abuts against the upper edge of the screw thread 121 of the screw rod 12. Thus, the screw seat 30 can be stably engaged with the screw rod 12 without shaking, so that the screw seats 30 at the four corners of the lifting platform 20 can be engaged with the screw rods 12 in cooperation with the respective springs 35. The screw seats 30 are in a stable coupling state. When it is necessary to adjust the position of the lifting platform 20, the hexagonal drive bit of the wrench 112 can be inserted into the drive hole 411 of the shaft seat 40 so that the wrench 112 can drive the sleeve 41 to rotate. The drive gear 23 is driven to drive the driven gear 25, such that the sprockets 24 are rotated synchronously by the chain 26, and each screw seat 30 is meshed with the screw thread 121 of the respective screw rod 12. When the lifting platform 20 is moved up and down, the screw seats 30 at the four corners of the lifting platform 20 are stable, without shaking, so as to achieve a more coordinated and smooth operation. The lower screw sleeve 32 is provided with a second keyway 328 below the outer threaded portion 324. The driven gear 25 has a mounting hole 251 for receiving the lower screw sleeve 32 and a second notch 252 corresponding to the second keyway 328. A second key 329 is disposed in the second keyway 328 and the second notch 252, so that the driven gear 25 and the lower screw sleeve 32 are coaxially rotated. The drive gear 23 has a diameter less than that of the driven gear 25. The driven gear 25 is directly driven by the drive gear 23 to achieve a labor-saving effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lifting structure of an engraving machine, the engraving machine including a lifting platform having pivot holes each corresponding in position to a screw rod, each of the pivot holes being provided with a screw seat for engagement of the screw rod; the lifting platform further having a connecting hole, the connecting hole being mounted with a rotatable shaft seat, a drive gear being provided below the shaft seat, a sprocket being provided below the screw seat, a driven gear being provided below the sprocket to mesh with the drive gear, the sprockets of the pivot holes being connected by a chain; the screw seat including an upper screw sleeve, a lower screw sleeve, an upper thrust bearing, a lower thrust bearing, and a spring, a top end of the upper screw sleeve being provided with a disc portion, the disk portion having at least two perforations and a central upper screw hole; the lower screw sleeve being rotatable in the pivot hole through the upper thrust bearing and the lower thrust bearing, a top end of the lower screw sleeve having a head portion, the head portion having two positioning screw holes corresponding in position to the perforations and a central lower screw hole, the spring being located between the upper screw sleeve and the lower screw sleeve, two screws passing through the perforations and being screwed to the positioning screw holes respectively, the upper screw sleeve being spaced from the lower screw sleeve; an outer wall of the lower screw sleeve being provided with an outer threaded portion, a bottom of the lower screw sleeve being coaxially connected with the sprocket; a disc spring being provided below the sprocket, the threaded portion being screwedly connected with a thread ring.

2. The lifting structure of the engraving machine as claimed in claim 1, wherein the shaft seat includes a sleeve, a first bearing, a second bearing, and a positioning plate, the sleeve has a central drive hole, an upper end of the sleeve is provided with a receiving portion, the receiving portion is formed with an annular groove, a C-shaped buckle is engaged in the annular groove, the sleeve is rotatable in the connecting hole through the first bearing and the second bearing, the positioning plate is located between the C-shaped buckle and the first bearing, and a bottom of the sleeve is coaxially connected with the drive gear.

3. The lifting structure of the engraving machine as claimed in claim 1, wherein the lifting platform is provided with an adjustment groove and an idler gear under the adjustment groove, and the idler gear is connected with an outer side of the chain.

4. The lifting structure of the engraving machine as claimed in claim 1, wherein the lower screw sleeve is provided with a first keyway above the outer threaded portion, the sprocket has a mounting hole for receiving the lower screw sleeve and a first notch corresponding to the first keyway, and a first key is provided in the first keyway and the first notch.

5. The lifting structure of the engraving machine as claimed in claim 4, wherein the lower screw sleeve is provided with a second keyway below the outer threaded portion, the driven gear has another mounting hole for receiving the lower screw sleeve and a second notch corresponding to the second keyway, and a second key is provided in the second keyway and the second notch.

6. The lifting structure of the engraving machine as claimed in claim 1, wherein the drive gear has a diameter less than that of the driven gear.

* * * * *